United States Patent [19]

Stumpf et al.

[11] Patent Number: 4,718,716

[45] Date of Patent: Jan. 12, 1988

[54] RECLINING CHAIR

[75] Inventors: William E. Stumpf, South Minneapolis, Minn.; Donald T. Chadwick, Los Angeles, Calif.; Bruce R. Gezon, Jenison, Mich.

[73] Assignee: Herman Miller, Inc., Zeeland, Mich.

[21] Appl. No.: 937,567

[22] Filed: Dec. 3, 1986

[51] Int. Cl.[4] ..... A47C 1/02

[52] U.S. Cl. ..... 297/85; 297/316; 297/408

[58] Field of Search ..... 297/85, 84, 70, 69, 297/316, 325

[56] References Cited

U.S. PATENT DOCUMENTS

| | | |
|---|---|---|
| Re. 25,375 | 4/1963 | Lorenz . |
| 2,788,058 | 4/1957 | Luckhardt . |
| 2,859,801 | 11/1958 | Moore . |
| 2,869,619 | 1/1959 | Petersen et al. . |
| 2,871,917 | 2/1959 | Schliephacke . |
| 2,892,485 | 6/1959 | Schliephacke . |
| 3,093,408 | 6/1963 | Fletcher . |
| 3,393,007 | 7/1968 | Fletcher . |
| 3,414,324 | 12/1968 | Taylor et al. . |
| 4,092,041 | 5/1978 | Landry et al. . |
| 4,188,062 | 2/1980 | Rogers, Jr. et al. . |
| 4,212,494 | 7/1980 | Dabney . |
| 4,212,495 | 7/1980 | Gall . |
| 4,386,803 | 6/1983 | Gilderbloom . |
| 4,429,917 | 2/1984 | Diffrient . |

*Primary Examiner*—Francis K. Zugel

*Attorney, Agent, or Firm*—Varnum, Riddering, Schmidt & Howlett

[57] ABSTRACT

A reclining chair (10) having a seat (12), backrest (14), side supports (16) and a reclining mechanism which includes a backrest bracket (34) rigidly affixed to the backrest (14) and pivotably mounted to a side support bracket (18), the side support bracket (18) being rigidly affixed to a side support (16). A seat support bracket (30) is rigidly affixed to the seat (12) and pivotably mounted to a side support bracket (18). A coupler link (40) has one end pivotably connected to the backrest bracket (34) and a second end pivotably connected to the seat support bracket (30). The axis of rotation of the backrest (14) is located so as to pass approximately through the hips of a chair occupant. Further, the linkages are so selected and arranged that the reclining motion and return motion take place by a horizontal translation of the center of gravity of the occupant to minimize the effort required to operate the reclining mechanism through its range of movement.

10 Claims, 11 Drawing Figures

RECLINING CHAIR

TECHNICAL FIELD

The invention relates to chairs and, more particularly, to chairs having a seat, backrest, and side supports and being adapted to recline. In one of its aspects, the invention relates to reclining chairs with adjustable headrests and extendable footrests.

BACKGROUND OF THE INVENTION

It is well known in the prior art for chairs, particularly "easy chairs" intended for residential use, to be adapted for reclining. The reclining of the chair is typically achieved by adapting the backrest to tilt rearward in conjunction with the forward and upward motion of the seat. Reclining chairs having the backrest and seat in a fixed relationship present several disadvantages. The rearward tilting of the backrest gives the chair occupant an unnatural "falling" sensation when coupled with the forward and upward movement of the seat. In addition, chairs having a back and seat which move relative to each other present disadvantages where the reclining motion causes movement of the backrest with relation to the occupant's back. The resulting friction tends to pull the occupant's upper garment and may irritate the skin of occupants with sensitive skin. This relative movement between the backrest and the occupant's back can occur if the relative movement of the contact surfaces of the chair and occupant do not approximately correspond to movement of the occupant's back with respect to the occupant's thighs. Finally, the chair occupant, to initiate the reclining motion, must exert a large force with either his or her legs or arms. This large force is necessary to overcome the occupant's body weight pressing down on the seat.

The U.S. Pat. No. 4,092,041 to Landry, et al (issued May 30, 1978) discloses a rocker recliner chair wherein reclining adjustments are made by moving the center of gravity of the chair occupant horizontally to minimize the effort for reclining or returning to the upright position. In Landry, the seat is hinged to the backrest and supported at a forward portion to a side suspension. The backrest is pivotably mounted to the suspension at a midpoint of the length thereof through an adjustable pivot. There is no disclosure in Landry of pivoting the seat rest with respect to the back to avoid shearing action between the occupant and the backrest.

The U.S. Pat. No. 2,859,801 to Moore, (issued Nov. 11, 1958), discloses a five bar linkage to control the reclining of a chair seat and back rest so as to eliminate friction between the chair back and the occupant's back when reclining. The axis of rotation of the backrest with respect to the seat corresponds with a pelvic axis, cross sectionally in line with the occupant's pelvis. The Moore five-bar linkage system comprises a backrest bracket, a seat bracket, a base bracket, and two connecting linkages. The bottom two linkages inter-connect the base bracket, the seat bracket and the backrest bracket. The Moore linkage system does not appear to translate the center of gravity of the occupant horizontally (without any substantial vertical component) so as to minimize the effort of the occupant in the reclining and return positions.

Many reclining chairs are provided with footrests adapted to move forward and upward as the chair is reclined. This movement of the footrest may be handle-actuated as in the U.S. Pat. No. 4,212,494 to Dabney (issued July 15, 1980) or may be controlled by reclining linkages as in the U.S. Pat. No. 3,393,007 to Fletcher (issued July 16, 1968); the U.S. Pat. No. RE 25,375 to Lorenz (issued Apr. 30, 1963); the U.S. Pat. No. 2,871,917 to Schliephacke (issued Feb. 3, 1959); the U.S. Pat. No. 2,892,485 to Schliephacke (issued June 30, 1959); and the U.S. Pat. No. 4,212,495 to Gall (issued July 15, 1980). In each of these chairs, however, the footrest remains at a fixed position in relation to the bracket to which the footrest is mounted. Thus, the footrest may be at an inconvenient location for chair occupants having short or long legs.

The use of a moveable headrest in conjunction with a chair is known. The U.S. Pat. No. 3,856,346 to Herman (issued Dec. 24, 1974) discloses a headrest controlled by a linkage system to move the headrest relative to the chair as the chair is reclined. The U.S. Pat. No. 4,188,062 to Rogers, Jr., et al (issued Feb. 12, 1980) discloses a similar headrest which "pops up" from a concealed position behind the seat back and is actuated by a linkage connected to the same handle that actuates movement of the footrest. The U.S. Pat. No. 3,492,045 to Schefthaler (issued Jan. 27, 1970) discloses a headrest mounted on an arm in such a way that it can be swung into the inside space of the backrest when not in use. The U.S. Pat. No. 4,078,841 to Kiang (issued Mar. 14, 1978) discloses a pillow member moveably secured to the backrest with a counter-weight on the opposite side of the seat and slidably contained within a sheath to permit the pillow to be moved to a desired position where it will remain. The U.S. Pat. No. 3,095,235 to Babcock, et al (issued June 25, 1963) discloses an hydraulically-operated bed chair having a headrest, the angular position of which relative to the backrest may be varied by means of a ratchet bar assembly.

SUMMARY OF THE INVENTION

The invention relates to a reclining chair having a backrest and a seat mounted to side supports so that the backrest reclines with respect to the seat with a minimum of shear between the occupant's back and the backrest, and further while the occupant's center of gravity translates essentially horizontally so that the effort for reclining and returning is minimized. Indeed, the reclining and return actions can take place by shifting parts of the anatomy. The reclining chair includes a backrest bracket which is rigidly affixed to the backrest and is pivotably mounted at each side thereof to a side support bracket. The side support bracket is rigidly affixed to a side support of the chair. A seat support bracket is rigidly affixed to the seat and is pivotably mounted to a side support bracket. A coupler link is pivotably mounted at one end to the backrest bracket and pivotably mounted at another end to the seat support bracket. The axis of rotation of the reclining chair passes through the approximate location of the hips of the chair occupant to minimize shear on the occupant's back during reclining and return to the upright position. The 4-bar linkage thus formed is so configured and arranged that the center of gravity of the occupant is translated in essentially a horizontal direction and without any substantial vertical movement so that the recline and return functions can occur with a minimum effort by the occupant.

The reclining chair can further include a headrest adapted to move between a first position adjacent to the backrest and a second position inclined forward of the backrest. The headrest is mounted to the top of the backrest by a linkage. One end of the linkage is pivotably mounted to the headrest, the other end of the linkage having a slot and pin. The pin is affixed to a cam mounted to the upper portion of the backrest. The cam has a slot in the upper portion thereof; it has a ramp surface on a rear face thereof. A plate on the headrest has a ramp surface complementary to the ramp surface on the cam so that as the headrest is pulled forwardly and upwardly by the chair occupant, the ramp surfaces slide over each other until the bottom of the plate on the headrest engages the slot in the upper portion of the cam.

The reclining chair can further comprise a leg rest and means mounting the leg rest to extend a leg rest forwardly and upwardly from a vertical, stored position under the seat to a horizontal leg-supporting position as the chair is reclined. The leg rest mounting means includes a track and means to slidably mount the leg rest to the track to extend the leg rest with respect to the leg rest mounting means.

The reclining chair can also include a release mechanism adapted to releasably secure the chair in the upright position, the reclined position, or in any of numerous intermediate positions. This release mechanism comprises a number of teeth protruding from the forward portion of the backrest bracket in an arc-like arrangement adapted to engage a tooth-like projection on a release arm. The release arm is pivotably mounted to the side support and contains a tooth-like projection adapted to engage the teeth on the forward portion of the seat support bracket. A handle is secured to the release arm to permit the toothlike projection to be disengaged from the teeth on the backrest bracket, hence allowing the chair to be moved between the upright, recline, or intermediate positions. The release mechanism can alternatively, comprise other positioning devices such as pneumatic cylinder mechanisms or friction clutch mechanisms.

BRIEF DESCRIPTION OF THE DRAWINGS

The invention will now be described with reference to the drawings in which.

DETAILED DESCRIPTION OF THE INVENTION

Figure 1:
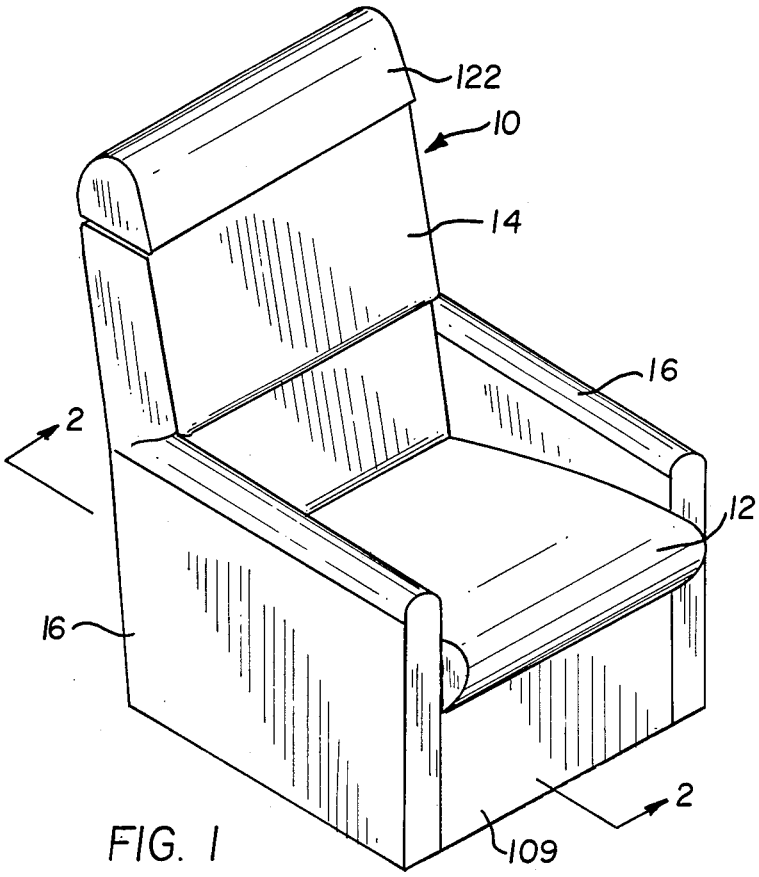
FIG. 1 is a perspective view of a reclining chair embodying the invention.

Referring now to the drawings and to FIG. 1 in particular, there is shown a reclining chair 10 having a seat 12, a backrest 14, and side supports 16. The chair is moveable between an upright position (shown), a fully reclined position (FIG. 7) and intermediate positions there-between. A leg rest 109 is provided beneath the seat 12. A headrest 122 is mounted above the backrest 14.

Figure 2:
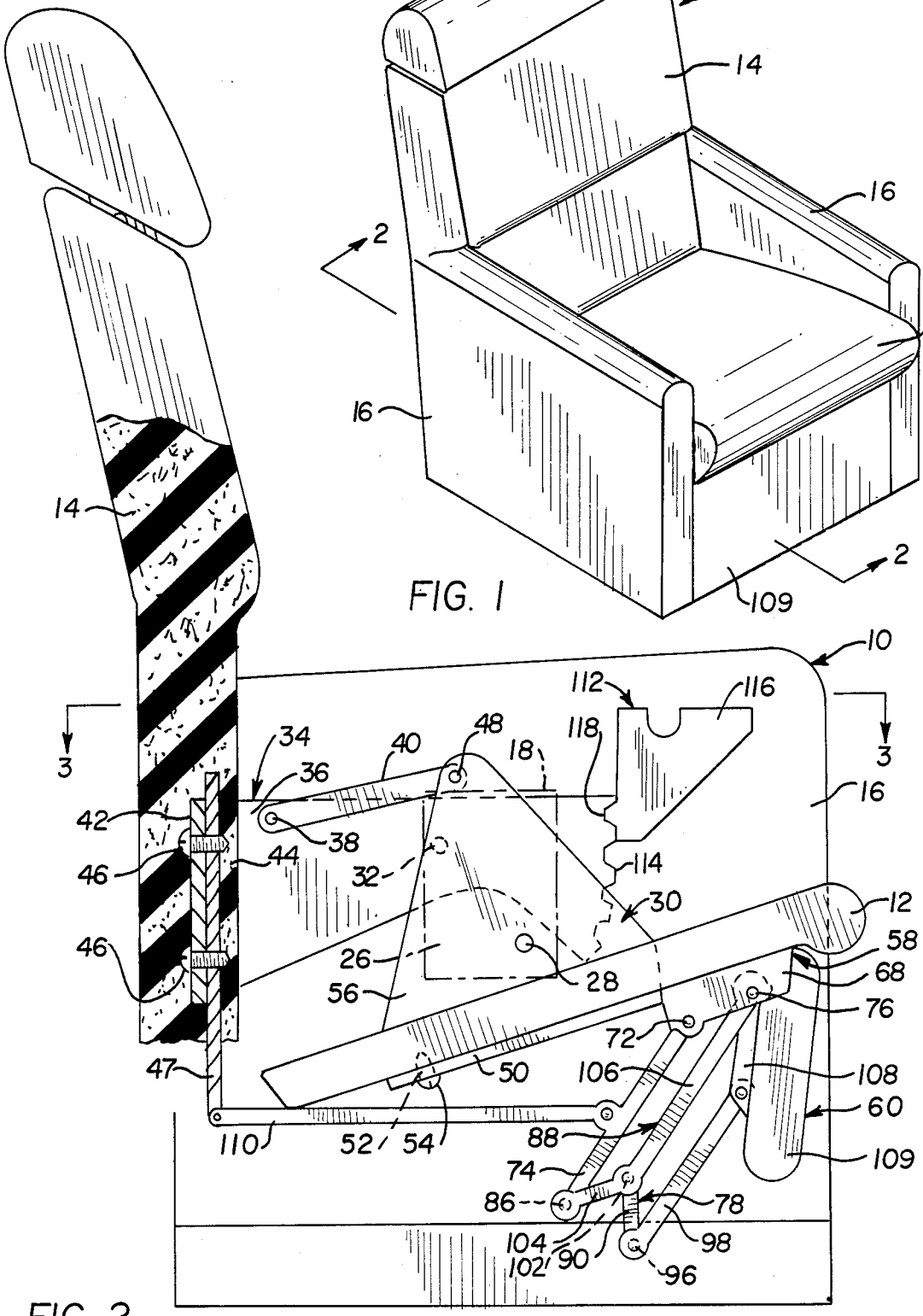
FIG. 2 is a side elevational view, in section, taken along line 2—2 of FIG. 1.
Figure 3:
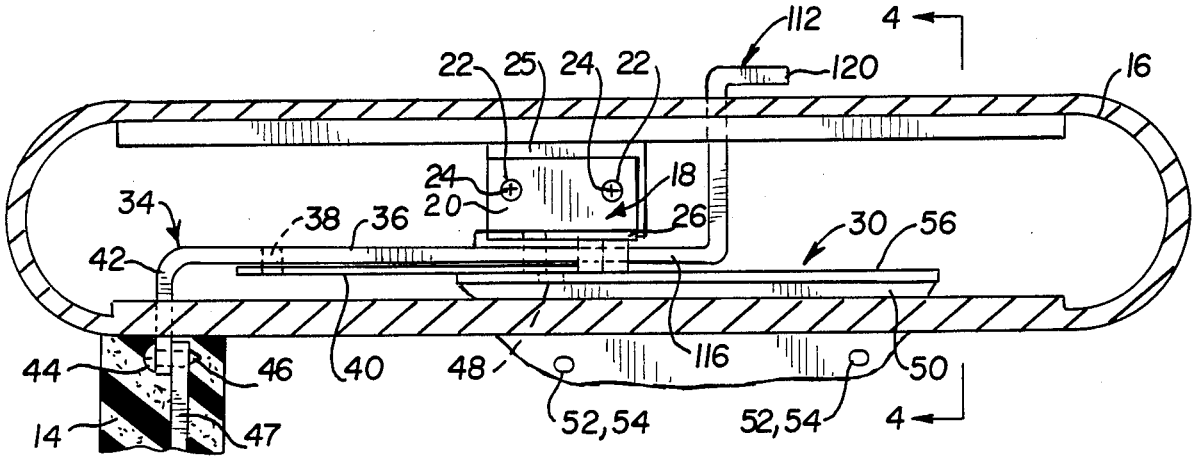
FIG. 3 is a partial sectional view taken along line 3—3 of FIG. 2.

Referring to FIGS. 2 and 3, a 4-bar linkage mechanism in each of the side supports 16 connects the seat and backrest together for reclining functions and supports the same on the side supports 16. For purposes of simplicity, only one linkage mechanism has been shown. The 4-bar linkage comprises a seat support bracket 30, a backrest bracket 34, a side support bracket 18 and a coupler link 40.

Figure 4:
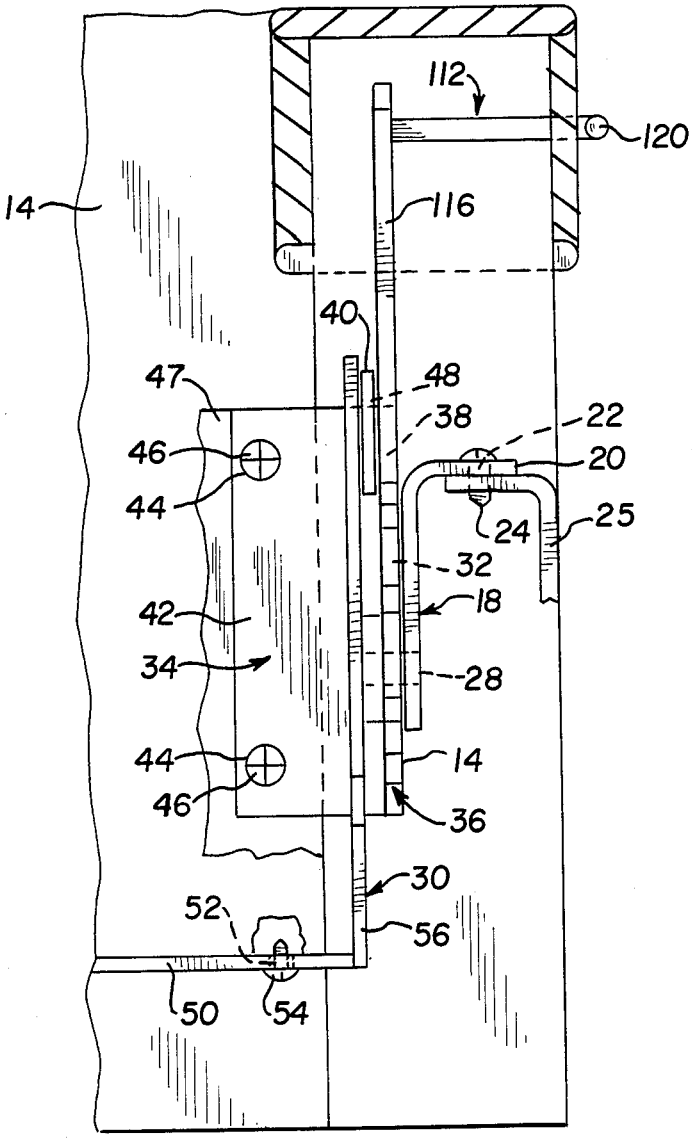
FIG. 4 is a sectional view taken along line 4—4 of FIG. 3.

As shown in FIGS. 3 and 4, each side support bracket 18 comprises an outwardly extending horizontal flange 20 having openings 22 adapted to receive conventional screws 24 to secure the side support bracket 18 to a plate 25 secured to the side support 16. A downwardly depending vertical flange portion 26 is provided at the inner edge of horizontal flange 20 and is adapted to receive a pivot pin 28 pivotably mounting a seat support bracket 30 and to receive a pivot pin 32 pivotably mounting a backrest bracket 34.

Each backrest bracket 34 includes a rearwardly extending plate 36 adapted to receive a pivot pin 38 pivotably mounting a coupler link 40 and to receive a pivot pin 32 pivotably connecting the backrest bracket 34 to the side support bracket 18. Each backrest bracket 34 further includes an inwardly-extending flange portion 42 having openings 44 therein adapted to receive screws 46 to rigidly affix the backrest 14 to a plate 47 secured to the backrest bracket 34.

Each coupler link 40 comprises an elongated link being pivotably mounted at one end at a pivot pin 38 to the backrest bracket 34 and being pivotably mounted at another end at a pivot pin 48 to the seat support bracket 30.

The seat support bracket 30 comprises an elongated cross-member 50 having openings 52 therein. The cross-member 50 is adapted to support the seat 12 and the openings 52 are adapted to receive screws 54 to secure the seat 12 to the seat support bracket 30. Upwardly extending vertical flanges 56 are provided at opposing ends of the cross-member 50 and are adapted to receive a pivot pin 48 pivotably mounting the coupler link 40 to the upward flange 56 and to receive a pivot pin 28 pivotably mounting the seat support bracket 30 to the side support flange 26.

Figure 8:
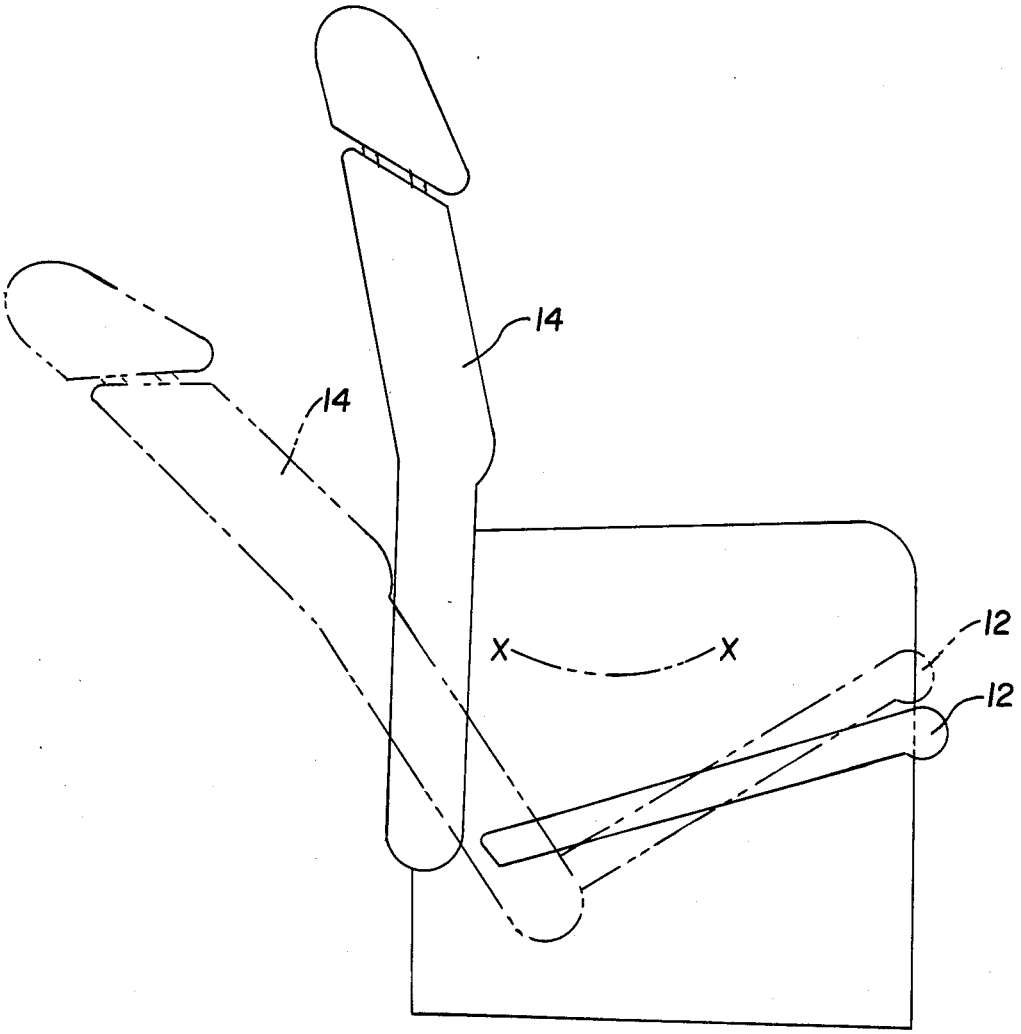
FIG. 8 is a side schematic view of a reclining chair embodying the invention showing the path traced by the chair occupant's center of gravity as the chair is reclined.

The linkages provided between the pivot pins 28, 32, 38 and 48 thereby form a 4-bar linkage comprising the coupler link 40, the backrest bracket 34, the side support bracket 18 and the seat support bracket 30. The linkages are configured and arranged so that the center of gravity of the occupant moves horizontally as the chair is moved from an upright position to a reclined position or an intermediate position there-between, or vice versa. This movement is illustrated in FIG. 8 in which the reclining position of the chair is illustrated in phantom lines. The movement of center of gravity of the occupant is illustrated in FIG. 8 by the phantom lines between the x—x. In this manner, a minimum of effort is required to move the chair from the upright to recline position and vice versa. Further, the linkages are configured and arranged so that the axis of rotation of chair 10 passes approximately through the hips of a chair occupant. In this manner, relative movement of backrest 14 with respect to seat 12 approximates the relative movement of the occupant's back with respect to the occupant's thighs. This approximate correspondence is achieved by means of the location of the axis of rotation of backrest 14 at or near the occupant's hips. As a result, the shear between the chair occupant's back and backrest 14 is minimized.

Figure 7:
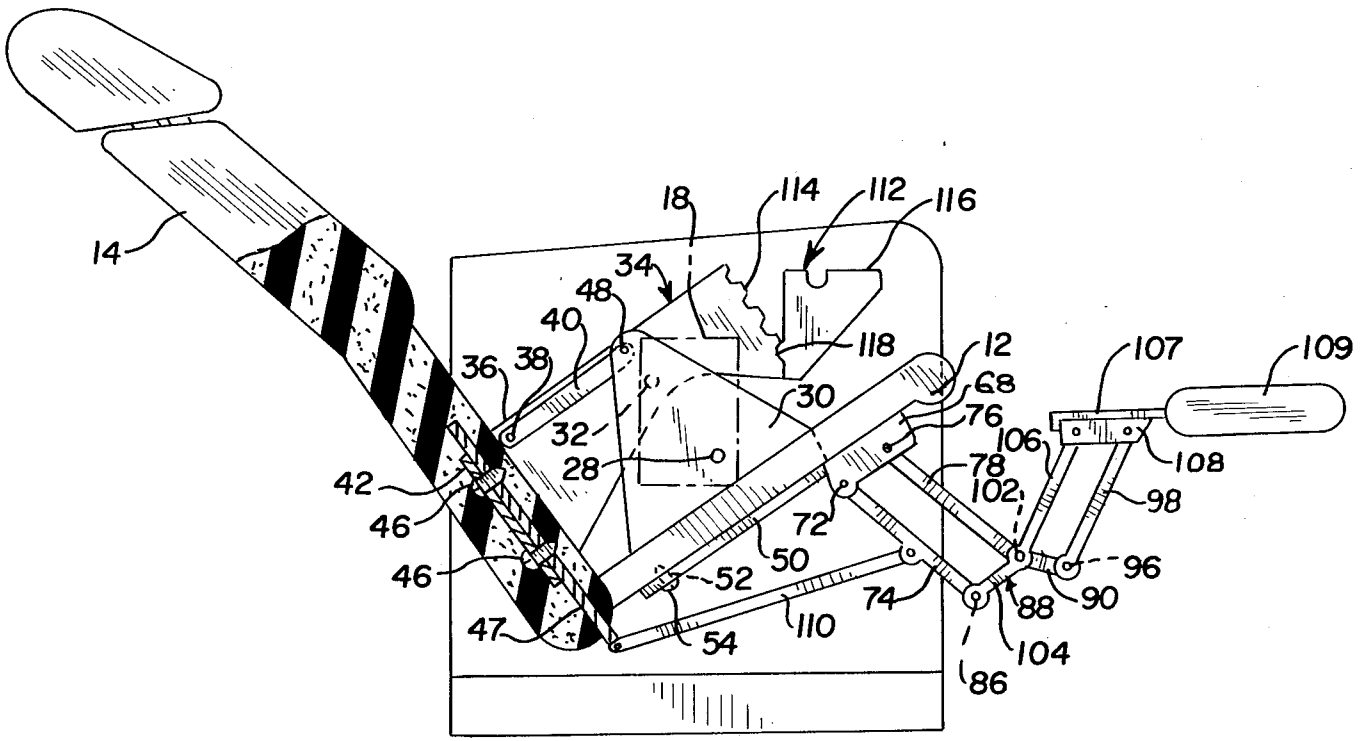
FIG. 7 is a side elevational view, in section, taken showing a reclining chair embodying the invention in a recline position.

Referring now to FIGS. 2 and 7, the seat support bracket 30 further comprises a forwardly-extending central portion 58 extending from cross-member 50 to support a leg rest mechanism 60. Downwardly-extending vertical flanges 68 depend from opposing edges of the forwardly-extending central portion 58 to receive the leg rest mechanism 60. The downwardly-extending flanges 68 are adapted to receive a pin 72 adapted to mount a rear rocker arm 74 and a pivot pin 76 adapted to mount a front rocker arm 78. Rear rocker arm 74 comprises an elongated link adapted to receive pivot pin 72 at the upper end thereof and also adapted to receive a pivot pin 86 at the opposite end thereof pivotably mounting a coupler arm 88 to the rear rocker arm 74. The front rocker arm 78 comprises an elongated link having a forwardly-extending portion 90 at the lower portion thereof. The front rocker arm 78 is adapted to receive pivot pin 76 and is also adapted to receive a pivot pin 96 to mount the front rocker arm 76 to a pair of rotation couplers 98. The front rocker arm 78 is also adapted to receive a pivot pin 102 at the upper portion of the forwardly-extending portion 90 to pivotably mount the front rocker arm 78 to a coupler arm 88.

Each coupler arm 88 comprises a first portion 104 extending between the lower opening (not shown) of rear rocker arm 74 and intermediate opening (not shown) of front rocker arm 78. Each coupler arm 88 further comprises a second portion 106 extending forwardly and upwardly from intermediate opening (not shown) of front rocker arm 78. A forward end of second portion 106 of coupler arm 88 is pivotably mounted to a leg rest support bracket 108.

Each rotation coupler 98 comprises an elongated link pivotably mounted at one end to front rocker arm 78 by means of pivot pin 96 and being pivotably mounted at an opposite end to leg rest support bracket 108. An actuator arm 110 comprises an elongated link being pivotably mounted at one end thereof to rear rocker arm 74 and being pivotably mounted at an opposite end thereof to a lower portion of backrest 14.

Figure 9:
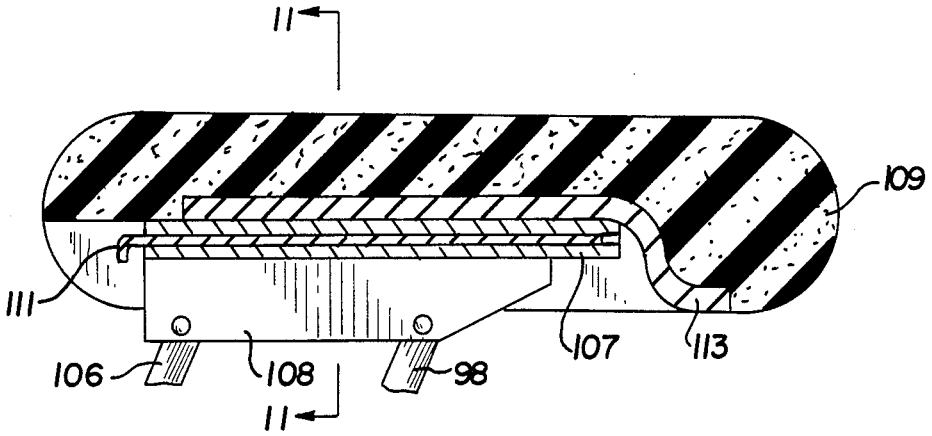
FIG. 9 is a side elevational view, in section, showing a footrest according to the invention in a first position.
Figure 10:
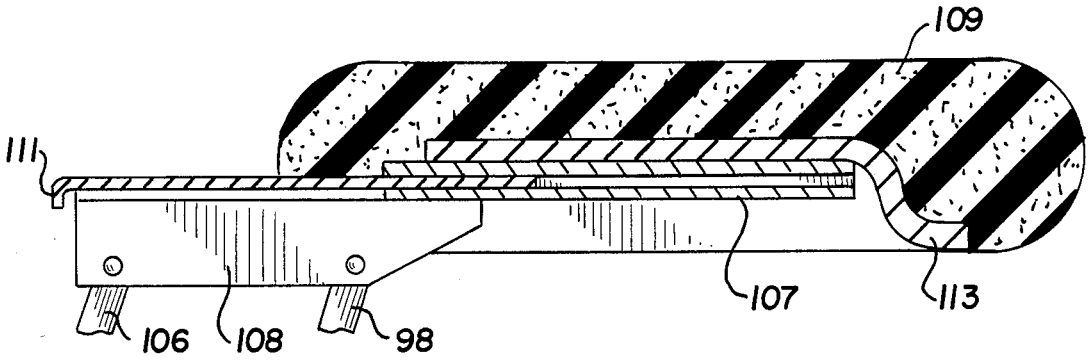
FIG. 10 is a side elevational view, in section, showing a footrest according to the invention in a second, extended position.
Figure 11:
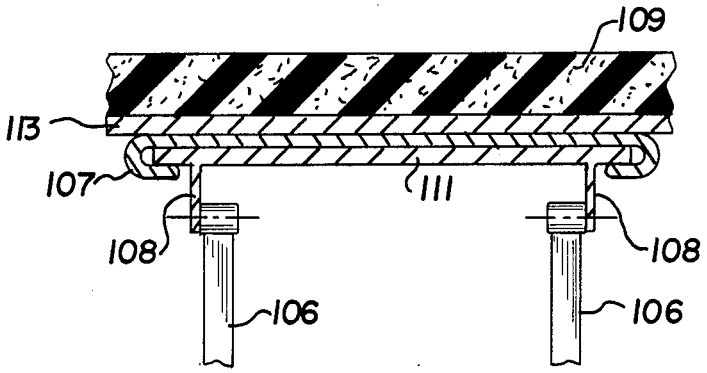
FIG. 11 is a cross-sectional view taken along Line 11—11 in FIG. 9.

As shown in FIGS. 9 and 10, a leg rest 109 is slidably mounted to leg rest support bracket 108 by means of a U-shaped track 107 secured within leg rest 109. In FIGS. 9 and 10, a foam cushion layer has been broken away to expose the supports and track 107. The foam cushion layer is mounted to a curved plate 113. The U-shaped track 107 is in turn mounted to the curved plate 113. Track 107 slidably engages an upper plate 111 which is secured to the leg rest support bracket 108 at the side thereof. Leg rest 109 may thereby be moved with respect to leg rest support bracket 108 to a position suited to the individual chair occupant. A latchtype mechanism (not shown) can be utilized to control the location of leg rest 109 with respect to bracket 108. A spring retracting mechanism (not shown) can also be utilized to return leg rest 109 to a retracted position with respect to bracket 108 automatically.

As shown in FIGS. 2, 4, and 7, a release mechanism 112 is provided to permit the reclining chair 10 to be secured in an upright, fully reclined, or intermediate position. The release mechanism 112 comprises a number of teeth 114 protruding from, and integral with, a forward portion of backrest bracket 34. The teeth 114 are arranged in an arc-like arrangement. A release arm 116 is pivotably mounted to the side support 16 and includes a tooth-like projection 118 protruding therefrom and adapted to engage the teeth 114. A handle 120 is secured to release arm 116 to allow the tooth-like projection 118 to be disengaged from the teeth 114. The reclining chair 10 may thereby be moved between upright, recline or intermediate positions when the handle 120 is depressed so as to disengage the tooth-like projection 118 from the teeth 114. The reclining chair 10 may not be moved between upright, recline or intermediate positions when the handle 120 is not depressed and the tooth-like projection 118 is engaged in the teeth 114. Alternatively, pneumatic positioner mechanisms or friction clutch mechanisms (not shown) can be utilized in place of the described release mechanism 112.

Figure 5:
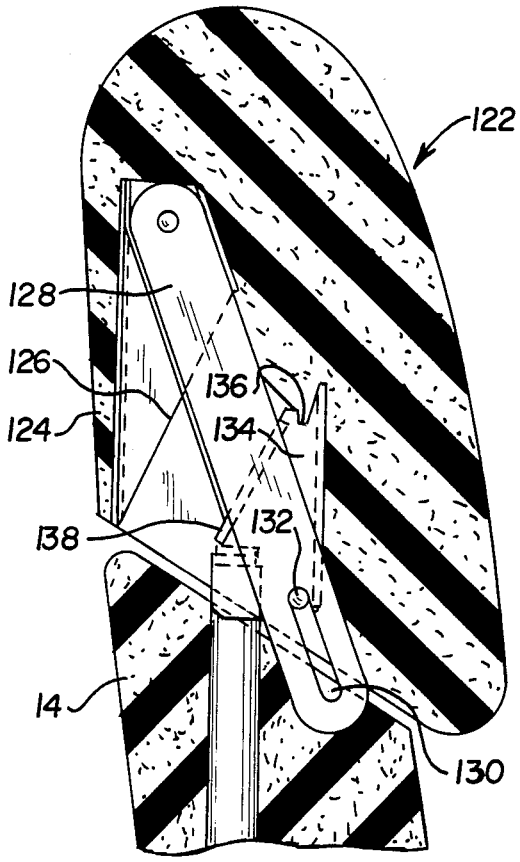
FIG. 5 is a side elevational view, section, showing a headrest according to the invention in a first position.
Figure 6:
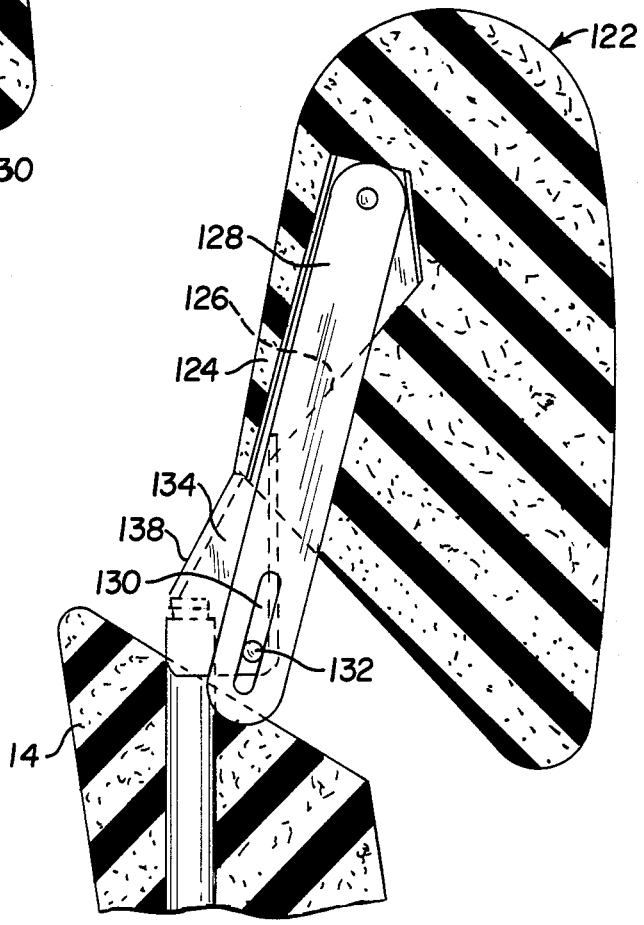
FIG. 6 is a side elevational view, in section, of the headrest according to the invention in a second, inclined position.

As shown in FIGS. 5 and 6, a headrest 122 is mounted to the top of backrest 14. The headrest 122 includes a downwardly-extending plate 124 at the rear portion thereof and a ramp surface 126.

A link 128 having a slot 130 at the lower end thereof is provided to mount headrest 122 to backrest 14. Link 128 is pivotably mounted at an upper end thereof to headrest 122. The slot 130 in link 128 is engaged by a pin 132 secured to a lower portion of a cam 134.

The cam 134 has a slot 136 at the upper portion thereof. The cam 134 also comprises a ramp surface complementary to ramp surface 126 so that as headrest 122 is pulled forwardly and upwardly by a chair occupant, ramp surface 126 slides over ramp surface 138 until the bottom of plate 124 engages slot 136 in the upper portion of the cam 134. As a result, the headrest 122 may be manually moved by the chair occupant from a first position adjacent to the backrest 14 to a second, inclined position and vice versa. This movement of headrest 122 adjusts both the relative inclination of the headrest. An extension mechanism (not shown) can be provided to adjust the relative height of headrest 122 with respect to backrest 14.

In use, a horizontal shift in the center of gravity of the chair occupant will cause the 4-bar linkage comprising the seat support bracket 30, backrest bracket 34, coupler link 40, and side support bracket 18 to rotate. This rotation causes the backrest 14 to rotate with respect to the seat 12 about an axis of rotation passing approximately through the hips of the chair occupant. This configuration maintains the position of the backrest 14 with relation to the seat 12 so as to avoid "pulling" of the chair occupant's upper garment. This configuration is such that the chair may be moved from the upright to the fully reclined position, and vice versa, by a horizontal shift of the center of gravity of the chair occupant. Because the center of gravity of the chair occupant need only be shifted horizontally, rather than vertically, a large force is not necessary to overcome the occupant's body weight to initiate tilting.

As the reclining chair 10 is moved, a second linkage comprising seat support bracket 30, front rocker arm 78, rear rocker arm 74, and coupler arm 88 also rotates. Leg rest mechanism 60 is thereby automatically actuated.

Movement of this second linkage causes the forward and upward movement of rotation coupler 98 and coupler arm 88. Leg rest 109 is thereby moved from a vertical position to a horizontal position. This footrest mechanism and the 4-bar linkage comprising seat support bracket 30, backrest bracket 34, coupler link 40 and side support bracket 18 share a common element in seat support bracket 30. Relative movement between those two positions of the invention is made by means of actuator arm 110. The horizontal location of leg rest 109 may be adjusted by the chair occupant by sliding leg rest 109 forwardly or rearwardly with respect to leg rest support bracket 108.

The principles of the invention are not limited to the specific embodiment herein described. Reasonable variations and modifications are possible within the scope of the foregoing disclosure without departing from the spirit of the invention.

The embodiments of the invention in which an exclusive property or privilege is claimed are defined as follows:

1. In reclining chair having a seat, backrest, and side supports, means mounting the seat and backrest to the side supports so that the backrest reclines with respect to the seat, the improvement in the mounting means comprises:

a backrest bracket rigidly affixed to said backrest for supporting said backrest;

side support brackets rigidly affixed to said side supports and pivotably mounting said backrest bracket;

a seat support bracket rigidly affixed to said seat and pivotably mounted to said side support brackets for pivotably supporting said seat on said side support brackets; and a coupler link having one end pivotably mounted to said backrest bracket and having a second end pivotably mounted to said seat support bracket for coordinating movement of said seat with said backrest;

the backrest bracket, the side support brackets, the seat bracket and the coupler link being so configured and arranged that an axis of rotation of said backrest with respect to said seat passes approximately through the hips of a chair occupant and so that the center of gravity of the chair occupant will be translated substantially horizontally upon rotation of said backrest with respect to said seat about said axis of rotation.

2. A reclining chair according to claim 1 and further comprising a headrest adapted to be moveable between a first position adjacent to said backrest and a second position forward and inclined from said backrest.

3. A reclining chair according to claim 2 wherein said headrest mechanism comprises:

a vertical plate at a rear portion of said headrest;

a ramp surface integral to said headrest for controlling movement of said headrest between a first position and a second, inclined position;

a guide link pivotably mounted at an upper end thereof to said headrest and having a slot at a lower end thereof and being adapted to connect said headrest to said backrest;

a cam having a ramp surface corresponding to said ramp surface integral to said headrest and having a slot at an upper portion thereof to engage said vertical plate; and a pin engaging said slot in said guide link to connect said link to said cam.

4. A reclining chair according to claim 1 and further comprising a leg rest and means mounting said leg rest to said seat support bracket to extend said leg rest forwardly and upwardly from a vertical, stored position beneath a front portion of said seat to a horizontal leg-supporting position.

5. A reclining chair according to claim 4 wherein said leg rest mounting means comprises a track and means to slidably mount said leg rest to said track to extend said leg rest with respect to said leg rest mounting means.

6. A reclining chair according to claim 1 and further comprising a release mechanism adapted to releasably secure said backrest and said seat in any one of a number of relative reclining positions.

7. A reclining chair according to claim 6 wherein said release mechanism comprises:

a plurality of teeth integral with and protruding from a forward portion of said seat support bracket in an arc-like configuration;

a release arm pivotably mounted to said side support and containing a tooth-like projection adapted to engage the teeth on the forward portion of said seat support bracket; and a handle secured to said release arm to allow said tooth-like projection to be disengaged from the teeth on said seat support bracket to allow movement of said reclining chair between positions.

8. A reclining chair according to claim 1 wherein said coupler link comprises an elongated link having a forward end pivotably mounted to an upper portion of said seat support bracket and further having a rear end pivotably mounted to a rear portion of said backrest bracket; said seat support bracket having a central portion thereof pivotably mounted to a lower portion of said side support bracket; and said backrest bracket having a forward portion thereof pivotably mounted to an upper portion of said support bracket.

9. A reclining chair according to claim 8 wherein reclining movement of said backrest bracket causes said coupler link to initiate forward and upward rotation of said seat support bracket.

10. A reclining chair according to claim 9 and further comprising a leg rest, means mounting said leg rest to said seat support bracket for movement forwardly and upwardly from a stored, vertical position to a horizontal, leg-supporting position, and vice versa; and means coupled between said backrest bracket and said leg rest mounting means to synchronize the reclining movement of said backrest with the forward and upward movement of said leg rest.

* * * * *